US009482044B2

(12) United States Patent
Wong

(10) Patent No.: US 9,482,044 B2
(45) Date of Patent: Nov. 1, 2016

(54) FORCED ENTRY RESISTANCE SYSTEM FOR WOODEN DOORS AND METHOD FOR MANUFACTURING DOORS WITH SUCH SYSTEM

(71) Applicant: Lung Fai Wong, Hong Kong (HK)

(72) Inventor: Lung Fai Wong, Hong Kong (HK)

( * ) Notice: Subject to any disclaimer, the term of this patent is extended or adjusted under 35 U.S.C. 154(b) by 0 days.

(21) Appl. No.: 14/597,229

(22) Filed: Jan. 15, 2015

(65) Prior Publication Data

US 2015/0204134 A1 Jul. 23, 2015

Related U.S. Application Data

(60) Provisional application No. 61/929,457, filed on Jan. 20, 2014.

(51) Int. Cl.

| | |
|---|---|
| ***E06B 5/11*** | (2006.01) |
| ***E06B 3/88*** | (2006.01) |
| ***E06B 3/82*** | (2006.01) |
| *E06B 3/70* | (2006.01) |

(52) U.S. Cl.

CPC ..... *E06B 5/113* (2013.01); *E06B 3/825* (2013.01); *E06B 3/88* (2013.01); *E06B 5/11* (2013.01); *E06B 2003/7046* (2013.01)

(58) Field of Classification Search

CPC ..... E05B 17/2084; E05B 15/0205; Y10T 292/68; Y10T 292/79; E06B 5/11; E06B 3/88; E06B 5/113; E06B 5/04; E06B 2003/7061; E06B 2003/7063; E06B 2003/7067

USPC ..... 292/340, 341.14, 346; 49/501, 504, 49/383, 462

See application file for complete search history.

(56) References Cited

U.S. PATENT DOCUMENTS

| | | | | |
|---|---|---|---|---|
| 2,399,666 A * | 5/1946 | Een | E06B 5/16 | 411/458 |
| 2,605,869 A * | 8/1952 | Backman | E06B 3/365 | 16/248 |
| 2,644,554 A * | 7/1953 | Katz | E06B 3/9649 | 403/230 |
| 3,286,424 A * | 11/1966 | Weyant | E04F 21/0007 | 49/501 |
| 3,386,216 A * | 6/1968 | Zwickert | E04B 2/821 | 49/504 |
| 3,633,312 A * | 1/1972 | Yeager | E05B 9/00 | 49/503 |
| 3,636,659 A * | 1/1972 | Bylicki | E05D 11/0027 | 292/DIG. 17 |
| 3,885,351 A * | 5/1975 | Imperial | E06B 7/2316 | 49/470 |
| 3,894,357 A * | 7/1975 | Stanfield | E06B 3/825 | 49/503 |

(Continued)

FOREIGN PATENT DOCUMENTS

| | | |
|---|---|---|
| CN | 2597646 Y | 1/2004 |
| CN | 202266164 U | 6/2012 |

(Continued)

OTHER PUBLICATIONS

Search Report of counterpart Hong Kong Short-term Patent Application No. 14112210.3 issued on Jan. 9, 2015.

*Primary Examiner* — Justin Rephann

(57) ABSTRACT

A forced entry resistance system for a wooden door built with a lock-stile and a hinge-stile includes one or more metal mounts pre-installed inside the door stiles and concealed by door panels. A doorframe mount may be pre-installed inside the lock-jamb at the lock-strike-plate and multiple doorframe mounts may be installed inside the hinge-jamb in the vicinity where door-stile fracture-resistant mounts and hinge reinforcement latch bolts are installed. A method for manufacturing a door and a doorframe with the forced entry resistance system is also disclosed.

17 Claims, 4 Drawing Sheets

(56) References Cited

U.S. PATENT DOCUMENTS 3,987,588 A * 10/1976 Imperial ..... E06B 7/2316 49/501
4,015,382 A * 4/1977 Noyes ..... E06B 1/02 49/504
4,281,479 A * 8/1981 Daus ..... E06B 3/827 49/503
4,281,480 A * 8/1981 Wendt ..... E06B 1/34 49/504
4,295,299 A * 10/1981 Nelson ..... E06B 1/34 292/246
4,640,052 A * 2/1987 Zebedee ..... E05D 11/0018 16/388
4,717,185 A * 1/1988 Hartley ..... E05B 15/0205 292/340
4,823,510 A * 4/1989 Amos ..... E05D 11/0027 292/DIG. 17
4,861,082 A * 8/1989 Priola ..... E05B 17/2003 292/340
5,154,461 A * 10/1992 Prescott ..... E05B 17/2084 292/272
5,214,878 A * 6/1993 Watt ..... E05D 5/0215 49/394
5,214,880 A * 6/1993 Woodruff ..... E06B 7/2316 49/470
5,216,839 A * 6/1993 Woodruff ..... E05D 5/0238 49/382
5,344,198 A * 9/1994 Elliott ..... E05B 17/2088 292/340
5,492,208 A * 2/1996 Goossens ..... E06B 5/164 292/2
5,566,995 A 10/1996 Jagiela
5,586,796 A * 12/1996 Fraser ..... E05B 15/0205 292/340
5,644,870 A * 7/1997 Chen ..... E06B 3/7001 49/501
5,769,473 A * 6/1998 Sovis ..... E05B 15/0205 292/340
5,845,439 A * 12/1998 Hendley ..... E06B 1/30 49/501
5,934,030 A * 8/1999 McDonald ..... E06B 1/30 49/505
5,979,137 A * 11/1999 Shoup ..... E06B 9/04 49/50
6,176,043 B1 * 1/2001 Gibbs ..... E05B 9/08 49/449
6,178,700 B1 * 1/2001 Mayer, Jr. ..... E06B 1/32 49/504
6,418,669 B1 * 7/2002 Suter ..... E05B 15/0205 292/346
6,434,899 B1 * 8/2002 Fortin ..... E06B 5/164 49/501
6,453,638 B2 * 9/2002 Chen ..... E06B 3/7015 52/717.01
6,619,005 B1 * 9/2003 Chen ..... E06B 3/5892 49/502
6,619,010 B2 * 9/2003 Wang Chen ..... E06B 3/825 49/501
6,651,390 B2 * 11/2003 Camperelli ..... E05B 15/0205 49/504
6,729,095 B2 * 5/2004 Wang Chen ..... E06B 3/5892 49/501
6,745,526 B1 * 6/2004 Autovino ..... E06B 3/74 52/232
7,024,820 B1 * 4/2006 Dustin ..... E06B 9/52 160/105
7,244,328 B1 * 7/2007 Robbins, Sr. ..... E06B 3/82 144/346
7,360,809 B1 * 4/2008 Poston ..... E05B 15/0205 292/340
7,467,818 B2 * 12/2008 Young ..... E05B 15/0205 292/341.14
7,866,113 B2 * 1/2011 Young ..... E05B 15/0205 292/346
7,886,501 B2 * 2/2011 Bartlett ..... E06B 3/88 52/717.01
8,166,707 B2 * 5/2012 Franschman ..... E06B 1/52 292/346
8,176,682 B2 * 5/2012 Gaviglia ..... E06B 5/18 49/400
8,418,427 B2 * 4/2013 Strickland ..... E06B 3/822 49/501
8,534,000 B1 * 9/2013 Fadlon ..... E06B 5/113 49/398
8,793,932 B1 * 8/2014 Lindgren ..... E06B 7/30 49/501
8,887,457 B1 * 11/2014 Knight ..... E06B 1/52 49/504
8,904,713 B1 * 12/2014 Anderson ..... E05B 17/2084 292/340
9,085,928 B2 * 7/2015 Yeremian ..... E06B 5/11
2001/0023557 A1 * 9/2001 Graham ..... E06B 1/10 49/504
2002/0046500 A1 * 4/2002 Hingston ..... E06B 5/11 49/501
2003/0029093 A1 * 2/2003 Childress ..... B60J 5/042 49/462
2003/0084616 A1 * 5/2003 Kimball ..... E05B 9/02 49/504
2003/0115817 A1 * 6/2003 Blackwell ..... E06B 7/086 52/456
2005/0011132 A1 * 1/2005 Griffin, Jr. ..... E05B 9/002 49/460
2006/0254153 A1 * 11/2006 Clancy ..... E06B 5/11 49/501
2006/0272247 A1 * 12/2006 Bartlett ..... E06B 3/88 52/232
2007/0094935 A1 * 5/2007 Molinari ..... E06B 3/822 49/503
2008/0016820 A1 * 1/2008 Robbins, Sr. ..... E06B 3/82 52/784.11
2008/0202034 A1 * 8/2008 Campbell ..... E05B 15/0205 49/504
2008/0224486 A1 * 9/2008 Anderson ..... E05B 15/0205 292/340
2008/0289547 A1 * 11/2008 Wakamatsu ..... E06B 5/11 109/76
2009/0282745 A1 * 11/2009 Franschman ..... E06B 1/52 49/504
2010/0115862 A1 * 5/2010 Young ..... E05B 9/002 52/204.1
2012/0085045 A1 * 4/2012 Torres ..... E05B 9/002 52/204.1
2013/0004260 A1 * 1/2013 Hesselback ..... E05B 9/08 411/366.1
2014/0165886 A1 * 6/2014 Yeremian ..... E06B 5/11 109/64
2015/0013249 A1 * 1/2015 Nielsen ..... E05B 15/0205 52/213
2015/0052835 A1 * 2/2015 Falter ..... E05C 1/10 52/204.1

FOREIGN PATENT DOCUMENTS

EP 0670407 A2 9/1995
GB 2197677 A 5/1988

* cited by examiner 61
60b
413
412
411
41
20'
212
211
215
10
30
10

61
41
21

10
30
10
20
512
511
60a
61

51
63
61

FORCED ENTRY RESISTANCE SYSTEM FOR WOODEN DOORS AND METHOD FOR MANUFACTURING DOORS WITH SUCH SYSTEM

CROSS-REFERENCE TO RELATED APPLICATIONS

This application claims the benefit of U.S. Provisional Patent Application No. 61/929,457 filed Jan. 20, 2014, the entire content of which is hereby incorporated by reference.

FIELD OF TECHNOLOGY

The present application relates to a forced entry resistance system for wooden doors and a method for manufacturing a door with a forced entry resistance system concealed inside the door and the doorframe.

BACKGROUND

Almost all apartment units are installed with a wooden door as protection against unwanted burglary entry. However, ordinary wooden doors are not strong enough to be an effective barrier for forced entries even the burglar only armed with simple burglary tools. That is because ordinary wooden door leaf and doorframe can fracture easily at its weakest areas near the door lock, lock-strike-plate, and hinges, especially when hammer, screwdriver or crowbar are used to crack open the wood structure of door sets. When the wood structure was cracked open, it will cause the lock and the hinges failed to hold the door in its closed position and create a security breach for millions of households.

Traditionally, there are three options available to enhance the security function of wooden doors: installing addition bold-lock and/or reinforcing the doorframe with external visible hardware, and/or supplementing with a metal gate. These options may prevent unwanted intruders but are not feasible for every apartment situations because of space limitation and appearance restriction, and may not even very effective.

For the bold-lock option, the concept of having addition locks installed in a wooden door may help to scare away burglars. This concept may be correct in theory, but doing so would require excessive drilling on the door leaf and doorframe, and would actually weaken its wood structure making it even easier to be fractured under external forces, and hence, defeated its purpose. Also the multi-lock system is costly, complicated and presents more chances of mechanical malfunctioning. Furthermore, it is costly, complicated and troublesome to repair or replace the locks. This option is not popular.

A second option is to insert or install additional hardware to an existing door or doorframe. However, since the hardware is designed specifically for certain types of door or doorframe, only a small number of households can use this option. Also, because the hardware is visible from outside and may damage the appearance of the door during insertion or installation, it may be easily available from hardware stores but not practical and adoptable by the mass public.

Another option is to install an expensive metal gate in front of a wooden door, as a supplemental security enhancement. The problem with this option is that it is not always feasible to install a metal gate in many apartment units because of its space requirements and possible violation of building fire codes. Also, many consumers complained about metal gate narrowed the width of their entrance, many dirty rusty parts, creating unpleasant prisoner feeling, boring design, very noisy, and too expensive. Furthermore, in many apartment buildings, metal gates are banned by property management or owner association who often would not approve any alteration or change of the appearance in common area. And in practice, metal gates are often rejected by the authority because the gate would swing onto the exit route or fire escape route or internal common corridor reducing the law-required width of such exit or corridor.

Therefore, there is a need to provide an improved wooden door system to reinforce the structure of the wooden door set (door leaf and doorframe) so that it can prevent the door leaf and doorframe from fracturing when burglaries try to have a forced entry.

The above description of the background is provided to aid in understanding a forced entry resistance system for wooden doors, but is not admitted to describe or constitute pertinent prior art to the forced entry resistance system for wooden doors, or consider the cited documents as material to the patentability of the claims of the present application.

SUMMARY

According to one aspect, there is provided a forced entry resistance system for a wooden door set including a lock-stile, a hinge-stile, a lock-jamb, and a hinge-jamb pre-installed with one or more fracture-resistant mounts concealed under door panels and inside a doorframe.

The one or more fracture-resistant mounts may include one or more door-stile fracture resistant mounts including (a) at least one rectangular plate mounted on one side of the hinge-stile; (b) at least one L-shaped plate having first and second panels perpendicular to each other, the first panel being mounted on an opposite side of the hinge-stile and the second panel being mounted on an inner side of the hinge-stile; and (c) a connecting screw inserted through a hole on the rectangular plate, and through a first predrilled through-hole on the hinge-stile, and tightly driven in a screw-hole on the first panel of the L-shaped plate.

In one embodiment, the one or more fracture-resistant mounts may include one or more door-stile fracture resistant mounts including (a) one rectangular plate mounted on one side of the hinge-stile; (b) two L-shaped plates each having first and second panels perpendicular to each other, the first panel being mounted on an opposite side of the hinge-stile and the second panel being mounted on an inner side of the hinge-stile; and (c) two connecting screws inserted through two holes on the rectangular plate, and through two first predrilled through-holes on the hinge-stile, and tightly driven in two screw-holes on the first panel of each L-shaped plate respectively. The length of the L-shaped plate may be 70-110 mm, the width of each panel of the L-shaped plate may be 20-30 mm, the length of the rectangular plate may be 300-400 mm, the width of the rectangular plate may 15-25 mm, and the thickness of the rectangular and the L-shaped plates may be 1-5 mm.

The forced entry resistance system may further include one or more doorframe fracture-resistant mounts pre-installed on and concealed by the doorframe from which a door is hung. The one or more doorframe fracture-resistant mounts may be installed at positions where the one or more door-stile fracture-resistant mounts are located.

In one embodiment, the doorframe fracture-resistant mount may be in the form of a U-shaped mount including two spaced-apart vertical plates received in two corresponding spaced-apart vertical grooves formed on a side of the doorframe abutting against a wall on which the doorframe is mounted, and at least one central plate connecting to and extending between the two vertical plates. The length of the two vertical plates may be 300-400 mm, the width of the two vertical plates may be 15-25 mm, the length of the central plate may be 70-110 mm, and the thickness of the vertical and central plates may be 1-5 mm.

The one or more fracture-resistant mounts may include a door-lock fracture-resistant mount pre-installed on the lock-stile at a position where a door lock is provided. In one embodiment, the door-lock fracture-resistant mount may include two vertical plates mounted on two opposite vertical sides of the lock-stile respectively, and a plurality of connecting members extending through a plurality of predrilled through-holes formed through the lock-stile respectively and connecting the two vertical plates together. The length of the two vertical plates may be 300-400 mm, the width of the two vertical plates may be 15-25 mm, and the thickness of the two vertical plates may be 1-5 mm.

The forced entry resistance system may further include a hinge-reinforcing latch bolt having a threaded rod and an enlarged head formed at one end thereof. The threaded rod may be inserted from a side of the hinge-stile facing the hinge-jamb of the doorframe through a second predrilled through-hole on the hinge-stile, and tightly driven in a screw-hole on the second panel of the L-shape plate. The enlarged head is adapted to be received in a bore predrilled in the hinge-jamb when a door is closed.

According to another aspect, there is provided a method for manufacturing a door with a forced entry resistance system. The method may include the steps of producing a door with a lock-stile and a hinge-stile; pre-installing one or more door-stile fracture-resistant mounts on the lock-stile and the hinge-stile; and concealing the one or more door-stile fracture-resistant mounts by a plurality of door panels.

The pre-installing step may include the step of preinstalling one or more door-stile fracture-resistant mounts on the hinge-stile at a position near a plurality of door hinges. The one or more door-stile fracture-resistant mounts may include (a) at least one rectangular plate mounted on one side of the hinge-stile; (b) at least one L-shaped plate having first and second panels perpendicular to each other, the first panel being mounted on an opposite side of the hinge-stile and the second panel being mounted on an inner side of the hinge-stile; and (c) a connecting screw inserted through a hole on the rectangular plate, and through a first predrilled through-hole on the hinge-stile, and tightly driven in a screw-hole on the first panel of the L-shaped plate.

The method may further include the steps of producing a hinge-reinforcing latch bolt having a threaded rod and an enlarged head formed at one end thereof; and inserting the threaded rod from a side of the hinge-stile facing a hinge-jamb of a doorframe through a second predrilled through-hole on the hinge-stile, and tightly driving the threaded rod in a screw-hole on the second panel of the L-shape plate, so that the enlarged head is adapted to be received in a bore predrilled in the hinge-jamb when the door is closed.

The pre-installing step may include the step of pre-installing a door-lock fracture-resistant mount on the lock-stile at a position where a door lock is provided. In one embodiment, the door-lock fracture-resistant mount may include two vertical plates mounted on two opposite vertical sides of the lock-stile respectively, and a plurality of connecting members extending through a plurality of predrilled through-holes formed through the lock-stile respectively and connecting the two vertical plates together.

The method may further include the steps of producing a doorframe with a hinge-jamb where the door hinges are installed; and pre-installing a doorframe fracture-resistant mount on the hinge-jamb at a position where each door-stile fracture-resistant mount is located.

The method may further include the steps of producing a doorframe with a lock-jamb; and preinstalling a doorframe fracture-resistant mount on the lock-jamb at a position where the door lock is located.

The concealing step may include the steps of producing a front door-panel and a back door-panel; and covering the one or more door-stile fracture-resistant mounts and the door-lock fracture-resistant mount by the front and back door-panels.

Although the forced entry resistance system for wooden doors is shown and described with respect to certain embodiments, it is obvious that equivalents and modifications will occur to others skilled in the art upon the reading and understanding of the specification. The forced entry resistance system for wooden doors in the present application includes all such equivalents and modifications, and is limited only by the scope of the claims.

BRIEF DESCRIPTION OF THE DRAWINGS

Specific embodiments of the forced entry resistance system for wooden doors will now be described by way of example with reference to the accompanying drawings wherein:

FIG. 1(*b*) is another exploded view of the wooden door with a forced entry resistance system according to an embodiment thereof.

FIG. 2(*b*) is an exploded view of a lock-jamb and a doorframe fracture-resistant mount according to an embodiment of the forced entry resistance system.

FIG. 2(*c*) is an exploded view of a hinge-jamb and two doorframe fracture-resistant mounts according to an embodiment the forced entry resistance system.

FIG. 3(*b*) is an enlarged front view of a doorframe fracture-resistant mount and a door-lock fracture-resistant mount of the forced entry resistance system according to an embodiment thereof.

FIG. 3(*c*) is an enlarged front view of a doorframe fracture-resistant mount and a door-stile fracture-resistant mount of the forced entry resistance system according to an embodiment thereof.

FIG. 3(*d*) is a perspective view of the doorframe fracture-resistant mount according to an embodiment thereof.

FIG. 3(*e*) is a perspective view of the door-lock fracture-resistant mount according to an embodiment of the forced entry resistance system.

FIG. 3(*f*) is a side view of a hinge-reinforcing latch bolt of the forced entry resistance system according to an embodiment thereof.

FIG. 3(*g*) is a perspective view of a door-stile fracture-resistant mount according to an embodiment of the forced entry resistance system.

FIG. 4(*b*) is an exploded view of the door-lock fracture-resistant mount and the doorframe fracture-resistant mount of the forced entry resistance system according to an embodiment thereof.

FIG. 4(*c*) is an exploded view of the door-stile fracture-resistant mount, the hinge-reinforcing latch bolt, and the doorframe fracture-resistant mount of the forced entry resistance system according to an embodiment thereof.

DETAILED DESCRIPTION

Figure 1:
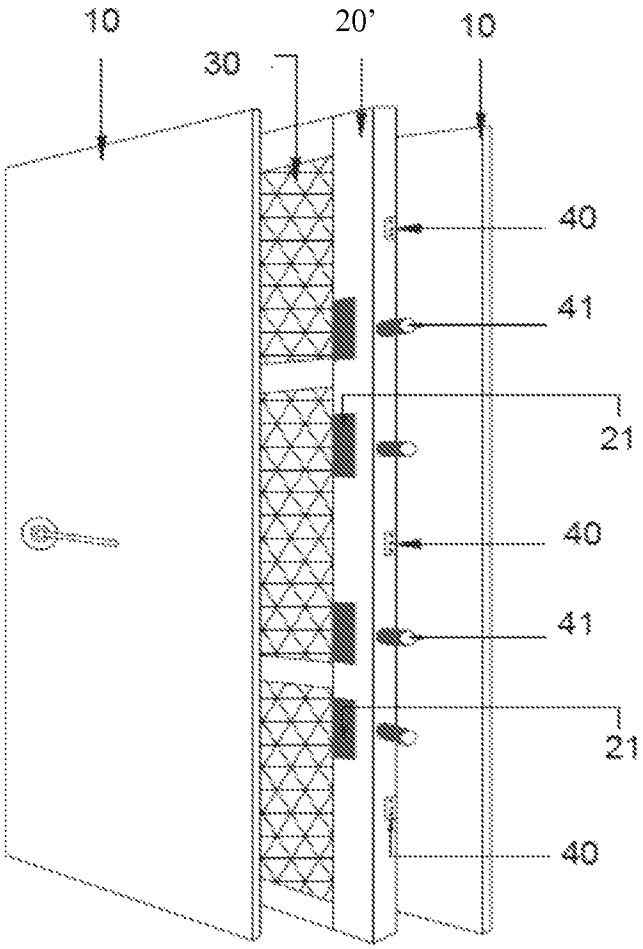
FIG. 1(*a*) is an exploded view of a wooden door with a forced entry resistance system according to an embodiment thereof.
Figure 1:
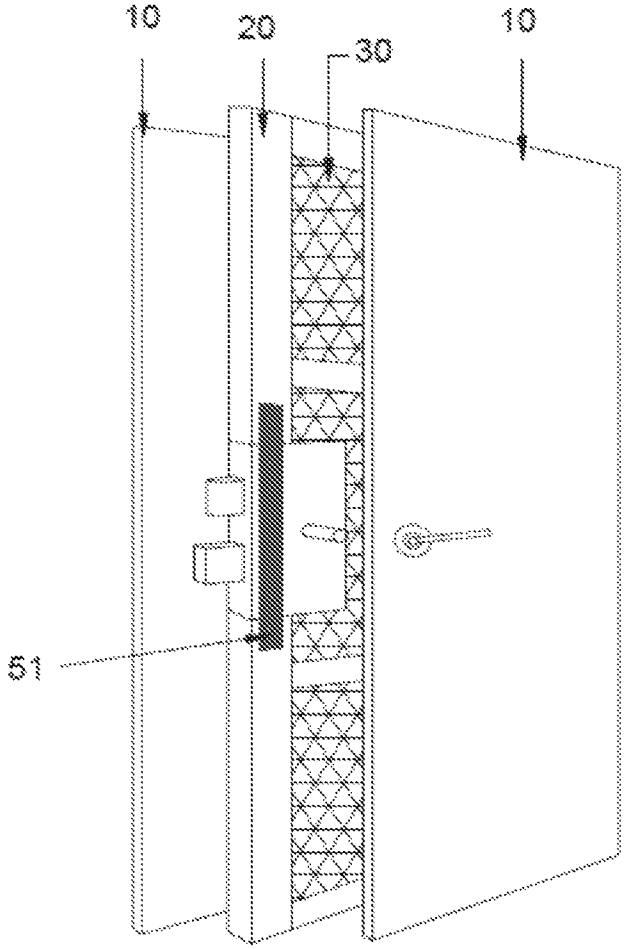

Reference will now be made in detail to a preferred embodiment of the forced entry resistance system for wooden doors, examples of which are also provided in the following description. Exemplary embodiments of the forced entry resistance system for wooden doors are described in detail, although it will be apparent to those skilled in the relevant art that some features that are not particularly important to an understanding of the forced entry resistance system for wooden doors may not be shown for the sake of clarity.

Furthermore, it should be understood that the forced entry resistance system for wooden doors is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the protection.

For illustration purposes, the terms "vertical", "horizontal", "outer", "inner", "front" or "back" appeared hereinafter relate to the invention as it is oriented in the drawings. It is understood that the invention may assume various positions, except where expressly specified to the contrary. Furthermore, it is understood that the specific devices shown in the drawings, and described in the following description, are simply exemplary embodiments of the invention. Hence, specific dimensions and other physical characteristics related to the embodiments disclosed hereinafter are not to be considered as limiting.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element or is in mechanical or electrical communication with another element.

FIGS. 1(*a*) and 1(*b*) are exploded views of a wooden door with a forced entry resistance system (FERS) according to an embodiment thereof. The wooden door may include a front panel and a back panel 10, a wooden lock-stile 20 (door stile where a door lock is installed), a wooden hinge-stile 20' (door stile where hinges are installed), and filling material 30. The lock-stile 20 can be used for mounting thereon a door lock. The hinge-stile 20' can be used for mounting thereon a plurality of door hinges 40. The filling material 30 can be used to fill up the space inside the door. These wood materials, namely the front panel, back panel, lock-stile, and hinge-stile, form the backbone structure of the wooden door.

The forced entry resistance system may include a forced entry resisting door-lock fracture-resistant mount 51, and one or more forced entry resisting door-stile fracture-resistant mounts 21. As used herein, the term "mount" means a metal strengthener or reinforcement brace designed to provide additional gripping force.

A plurality of hinge-reinforcing latch bolts 41 may be mounted on the hinge-stile 20' near the door hinges 40 for reinforcement thereof. The number of the latch bolt 41 may depend on the height of the door and the number of door hinges.

Figure 2:
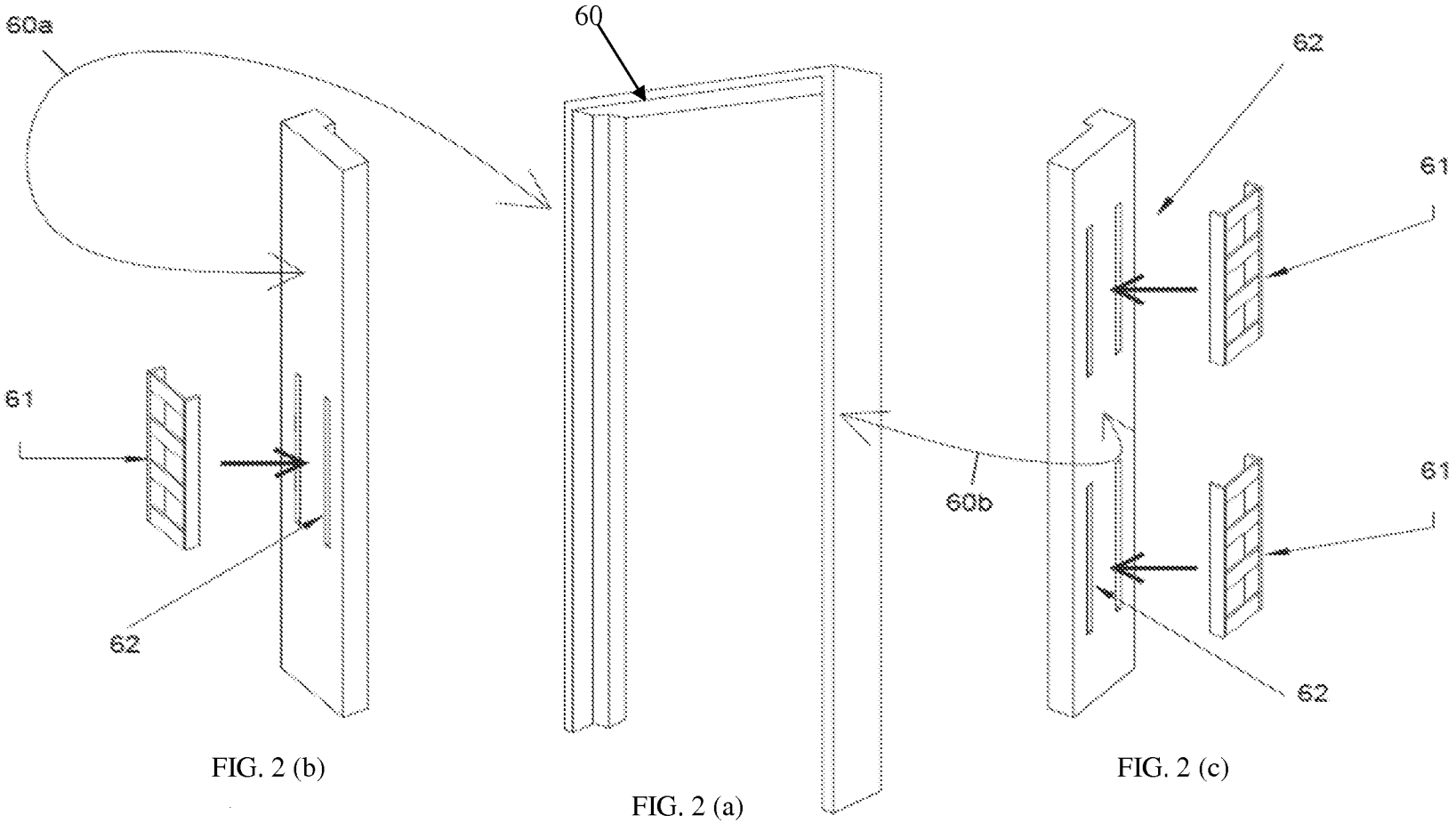
FIG. 2(*a*) is a perspective view of a doorframe within which the door is mounted.

FIG. 2(*a*) is a perspective view of a doorframe 60 within which the door can be hung. The doorframe 60 may include a vertical wooden lock-jamb 60*a* as illustrated in FIG. 2(*b*), and a vertical wooden hinge-jamb 60*b* as illustrated in FIG. 2(*c*).

According to the illustrated embodiment, a doorframe fracture-resistant mount 61 may be mounted on the lock-jamb 60*a* by means of a pair of parallel spaced-apart vertical grooves 62 formed on one side of the lock-jamb 60*a* which is abutting against a wall on which the lock-jamb 60*a* is mounted. Two doorframe fracture-resistant mounts 61 can be mounted on the hinge-jamb 60*b* by means of two pairs of parallel spaced-apart vertical grooves 62 formed on one side of the hinge-jamb 60*b* which is abutting against a wall on which the hinge-jamb 60*b* is mounted. The depth of the vertical grooves 62 should be so determined that the doorframe fracture-resistant mounts 61 would not protrude outwardly from the vertical lock-jamb 60*a* and the vertical hinge-jamb 60*b* when they are mounted inside the grooves 62. The doorframe fracture-resistant mount 61 can be mounted in the vicinity the door lock and the hinge-reinforcing latch bolts 41 are installed.

Although it has been shown and described that there is only one doorframe fracture-resistant mount 61 installed in the lock-jamb 60*a* and two doorframe fracture-resistant mounts 61 installed in in the hinge-jamb 60*b*, it is understood that the number of doorframe fracture-resistant mounts 61 may vary depending on the height of the door and the number of locks and hinge-reinforcing latch bolts 41 installed on the door.

Figure 3:
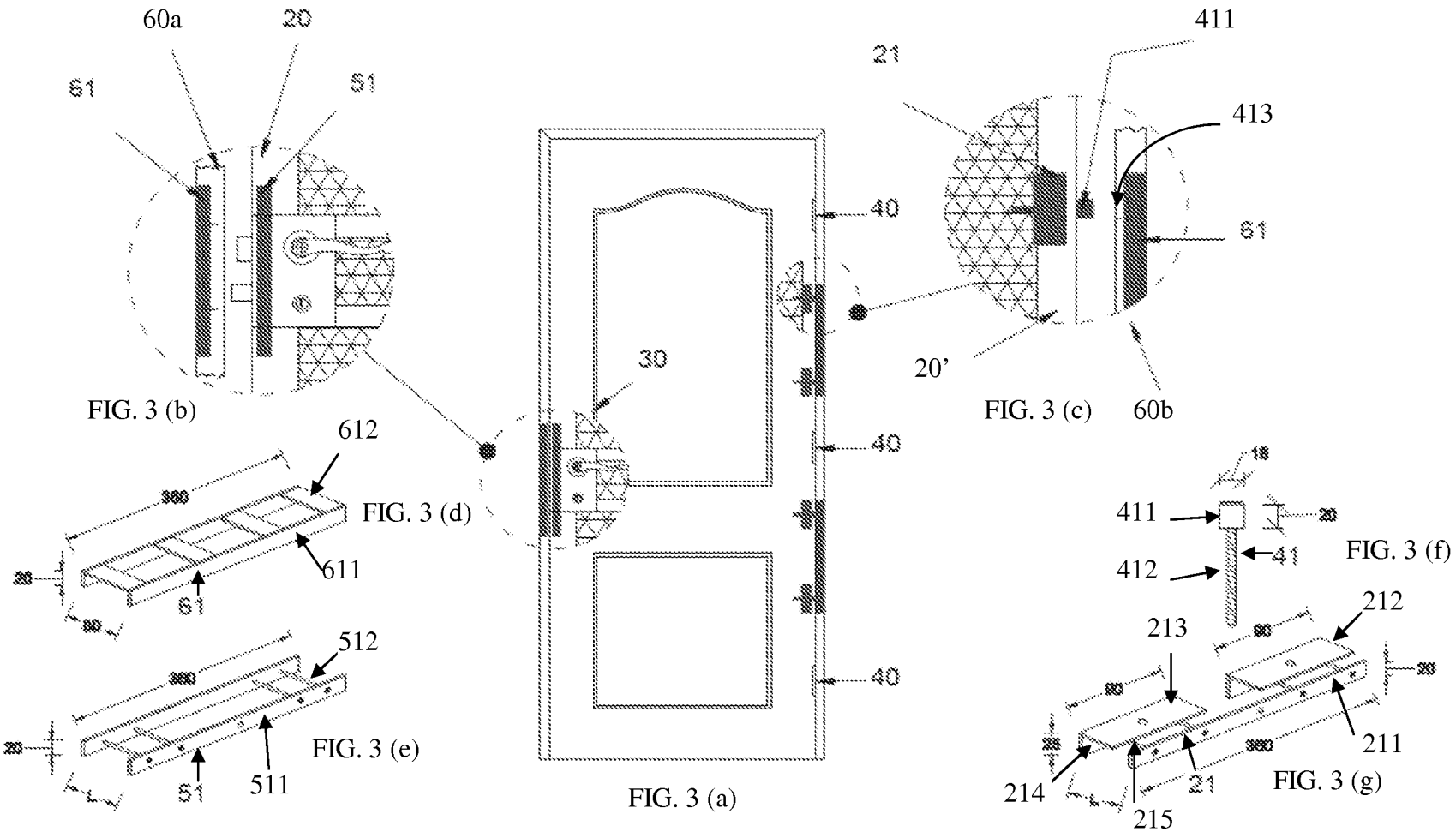
FIG. 3(*a*) is a front view of the door with the forced entry resistance system according to an embodiment thereof.

FIG. 3(*a*) is a front view of the door with the forced entry resistance system according to an embodiment thereof. FIG. 3(*b*) is an enlarged front view of the doorframe fracture-resistant mount 61 and a door-lock fracture-resistant mount 51 of the forced entry resistance system; and FIG. 3(*c*) is an enlarged front view of the doorframe fracture-resistant mount 61, the hinge-reinforcing latch bolt 41, and the door-stile fracture-resistant mount 21 of the forced entry resistance system.

FIG. 3(*d*) is a perspective view of the doorframe fracture-resistant mount 61 of the forced entry resistance system. According to the illustrated embodiment, the doorframe fracture-resistant mount 61 may be in the form of a U-shaped mount. The doorframe fracture-resistant mount 61 may include two spaced-apart vertical plates 611 adapted to be received in the two corresponding spaced-apart vertical grooves 62 formed on the lock-jamb 60*a*. One or more central plates 612 may connect to and extend between the two vertical plates 611. According to the illustrated embodiment, there are four spaced central plates 612 connecting the two vertical plates 611.

The dimensions of the doorframe fracture-resistant mount 61 may depend on the thickness and the width of the lock-jamb 60*a*. For example, the length of the two vertical plates 611 may be in the region of 300-400 mm, and preferably 360 mm. The width of the two vertical plates 611 may be in the region of 15-25 mm, and preferably 20 mm. The length of the central plates 612 may be in the region of 70-110 mm, and preferably 80 mm. The thickness of the two vertical plates 611 and the central plates 612 may be in the region of 1-5 mm, and preferably 3 mm. The doorframe fracture-resistant mount 61 may be made of stainless steel or any other suitable material.

FIG. 3(*e*) is a perspective view of the door-lock fracture-resistant mount 51 of the forced entry resistance system. According to the illustrated embodiment, the door-lock fracture-resistant mount 51 may include two vertical plates 511 mounted on two opposite vertical sides of the lock-stile 20, and a plurality of connecting members 512 extending through a plurality of through-holes formed through the lock-stile 20, and connecting the two vertical plates 511 together. According to the illustrated embodiment, there are four connecting screws 512 provided for connecting the two vertical plates 511 together, and the through-holes are disposed perpendicular to a plane on which the door lies.

The length of the two vertical plates 511 may be in the region of 300-400 mm, and preferably 360 mm. The width of the two vertical plates 511 may be in the region of 15-25 mm, and preferably 20 mm. The length of the connecting member 512 may depend on the thickness of the door. The thickness of the two vertical plates 511 may be in the region of 1-5 mm, and preferably 3 mm. The door-lock fracture-resistant mount 51 may be made of stainless steel or any other suitable material.

FIG. 3(*g*) is a perspective view of the door-stile fracture-resistant mount 21 of the forced entry resistance system according to an embodiment thereof. According to the illustrated embodiment, the door-stile fracture-resistant mount 21 may include a rectangular plate 211 and two L-shaped plates 212.

Each of the two L-shaped plates 212 may include first and second panels 214, 213 perpendicular to each other. The first panel 214 may be mounted on an opposite side of the hinge-stile 20' and the second panel 213 may be mounted on an inner side of the hinge-stile 20'. Two connecting screws 215 can be inserted through two holes on the rectangular plate 211, and through two first predrilled through-holes on the hinge-stile 20', and tightly driven in two first screw-holes on the first panel 214 of each L-shaped plate 212 respectively.

The dimensions of the rectangular plate 211 and the L-shaped plates 212 may be set according to the height and the thickness of the door. For example, the length of each L-shaped plate 212 may be in the region of 70-110 mm, and preferably 90 mm. The width of each panel 213, 214 of L-shaped plate 212 may be in the region of 20-30 mm, and preferably 25 mm. The length of the rectangular plate 211 may be in the region of 300-400 mm, and preferably 360 mm. The width of the rectangular plate 211 may be in the region of 15-25 mm, and preferably 20 mm. The thickness of the rectangular plate 211 and the L-shaped plates 212 may be in the region of 1-5 mm, and preferably 3 mm. The length of the screws 215 may depend on the thickness of the door. The door-stile fracture-resistant mount 21 may be made of stainless steel or any other suitable material.

FIG. 3(*f*) is a side view of the hinge-reinforcing latch bolt 41 of the forced entry resistance system according to an embodiment thereof. The latch bolt 41 may be in the shape of a bolt and may include a threaded rod 412 and a smooth enlarged head 411 formed at one end thereof.

The threaded rod 412 may be inserted from a side of the hinge-stile 20' facing the hinge-jamb 60*b* of the doorframe through a second predrilled through-hole on the hinge-stile 20', and tightly driven in a screw-hole on the second panel 213 of the L-shape plate 212. The enlarged head 411 is adapted to be received in a bore 413 (FIG. 3(*c*)) predrilled in the hinge-jamb 60*b* when the door is closed.

After the latch bolt 41 is completely driven through the hinge-stile 20' and the screw-hole on the second panel 213 of the L-shaped plate 212, the enlarged head 411 is protruding outwardly from the door. The protruding enlarged head 411 would not obstruct the opening and closing of the door. When the door is closing, the enlarged head 411 would insert into a bore 413 (FIG. 3(*c*)) predrilled into the hinge-jamb 60*b*. The length of the enlarged head 411 of the hinge-reinforcing latch bolt 41 may be about 20 mm. The hinge-reinforcing latch bolt 41 may be made of stainless steel or any other suitable material.

Figure 4:
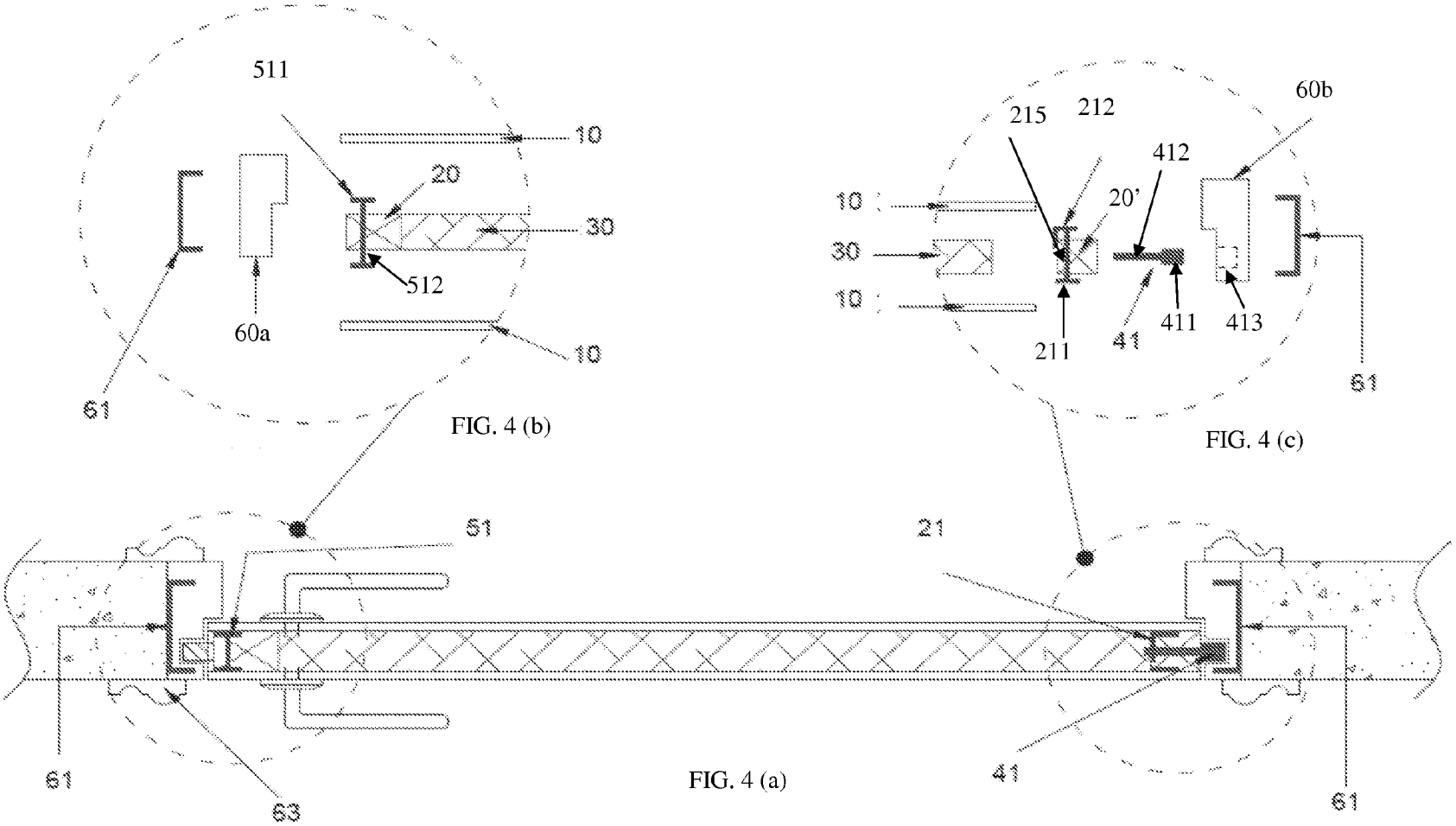
FIG. 4(*a*) is a cross sectional view of the door with the forced entry resistance system according to an embodiment thereof.

FIG. 4(*a*) is a cross sectional view of the door with the forced entry resistance system according to an embodiment thereof. FIGS. 4(*b*) and 4(*c*) show the manufacture of the door with the forced entry resistance system.

A plurality of door moldings 63 may be installed to conceal the gaps between the lock/hinge jambs 60*a*, 60*b* and the wall on which the lock/hinge jambs 60*a*, 60*b* are mounted.

A method for assembling a door with a forced entry resistance system is also disclosed. The method may include assembling of a door having a lock-stile preinstalled with the Door-Lock Fracture-resistant Mount and a hinge-stile pre-installed with one or more Door Stile Fracture-resistant Mounts; then covering the mounts by front and back door panels. It also disclosed the locations where these mounts should be installed. As used herein, the term "preinstalled" means "already installed by a manufacturer before selling it to a consumer".

The method may further include the steps of installing a hinge-reinforcing latch bolt having a threaded rod and an enlarged head formed at one end thereof; and inserting the threaded rod from a side of the hinge-stile facing a hinge-jamb of a doorframe through a second predrilled through-hole on the hinge-stile, and tightly driving the threaded rod in a screw-hole on the second panel of the L-shape plate, so that the enlarged head is adapted to be received in a bore predrilled in the hinge-jamb when the door is closed.

The assembling steps may include the step of pre-installing a door-lock fracture-resistant mount on the lock-stile at a position where a door lock is provided. The door-lock fracture-resistant mount may include two vertical plates mounted on two opposite sides of the lock-stile respectively, and a plurality of connecting members extending through a plurality of through-bores formed through the lock-stile respectively and connecting the two vertical plates together.

The method may further include the steps of producing a doorframe with a hinge-jamb pre-installed with a plurality of door frame fracture-resistant mounts in the vicinity of door hinges.

The method may further include the steps of producing a doorframe with a lock-jamb preinstalled with a doorframe fracture-resistant mount at a position where the lock-strike-plate is located.

Without changing the original material, the outer appearance and the structure of the wooden door, the forced entry resisting devices of the system can be installed inside the door at the weakest areas, namely the area where the lock is located and the vicinity near the door hinges 40. FIGS. 1(*a*) and 1(*b*) show the positions where the forced entry resisting devices are installed to strengthen the lock-stile 20 and the hinge-stile 20' of the door. The lock-stile 20 and the hinge-stile 20' are the backbones of the door for supporting the door, the door lock and the door hinges as a whole. If the lock-stiles 20 and the hinge-stile 20' of the door are fractured by external forces, then the door lock and the door hinges would fall apart and the door would be opened.

The forced entry resistance system (FERS) presents an innovative option to armor an ordinary wooden door enhancing its security function. It has many advantages over the bolt-lock, external hardware, and metal gate options. It does not alter the appearance of the door leaf or the doorframe, and can be installed in almost any ordinary wooden door sets. It does not obstruct the pathway of the common area or exit routes. It can protect the lock and hinges and hence keep the door in a closed position preventing a burglary forced entry. It is a better solution for apartment dwellers who are concerned about the security capability of their wooden door. This is very useful for highly populated cities, like New York, San Francisco, Los Angeles, Chicago, Dallas, etc., where majority of residents are living in apartment buildings.

The FERS consists of four specially designed steel devices made for enhancing the security function of wooden door sets. They are made of stainless steel and steel cylinder and are pre-installed inside the door leaf and the doorframe near the lock and hinge areas. These devices can provide extra mounting forces to support the wood structure of door leaf and doorframe from fracturing. They are invisible but can generate the extra holding forces to the lock and hinge and at the same time do not cause any obstacle to normal lock or hinge operation. There are no moving parts in these devices and hence minimized the risk for mechanical failure. These steel devices include the Hinge Reinforcement Latch Bolt (HRLB) 41, the Door Lock Fracture-resistant Mount (DLFM) 51, the Door Stile Fracture-resistant Mount (DSFM) 21, and the Door Frame Fracture-resistant Mount (DFFM) 61.

Most burglars would choose to crack open the lock of an entrance door by forces, by heavy impact, or by jamming the door lock with simple burglar tools, i.e. hammer, screwdriver or crowbar. Two mounting devices, namely DLFM 51 and DFFM 61, are specially designed to protect the lock from failure even under these burglary forces. First, the DLFM 51 can be installed into the lock-stile clamping the lock from both sides of the stile, yet invisible from outside. It creates a mounting force to tightly hold the stile from fracturing near the lock area when external burglary forces are applied to the door lock, thus, preventing the door lock to get loose and fails. Another mounting device, the DFFM 61 is strategically installed into the doorframe to provide a very strong mounting force to area near the lock-strike-plate where the lock-bolt latched. Again, with the support from DFFM 61, the doorframe can hold the lock-strike-plate and lock-bolt in its normal effective position and hence, keeping the lock to continue to provide its security function, even under heavy impact or jimmied by burglar tools.

Another common method used by burglars to force entering an apartment is to crack open the entrance door from the hinge side. A wooden door armored with the FERS devices and its three specially designed FERS devices is capable to strengthen and protect the hinges from failing. Four steel Hinge Reinforcement Latch Bolts (HRLB) 41 can be installed into the door leaf near the hinges, and when the door is closed the latch bolts will automatically push-into the doorframe. These latch bolts can create a much stronger holding force than normal hinges, keeping the door in its closed position even the hinges are damaged by burglary impact forces. To ensure the door leaf and doorframe will not be fractured at the area where the steel latch bolts (HRLB 41) are installed, two mounting devices (DSFM 21) can be installed in the hinge-stile with two corresponding mounting devices (DFFM 61) installed into the hinge-jamb of the doorframe near the hinge areas.

When all the four stainless steel mounts and the latch bolts are installed properly, they create a reinforced door system with strong clamping forces on both side of a wooden door set; mounting the wood stiles inside the door and mounting the doorframe structure from inside, and hence reducing the risk of fracturing when external burglary forces applied to the lock or hinge areas. The FERS can change an ordinary wooden door into an impact resisting and forced-entry resisting door, making it a stronger and better security door, and yet, not visible from outside.

Statistically, burglary rate in apartments and houses are rising in big cities. This alarming statistics reflected the security function of entrance door is becoming a very serious matter and must be dealt with effectively, in particular, for apartments using the ordinary wooden doors that have very little capability to stop burglary forced entry. This is why the FERS is designed to provide an effective, reliable, affordable, easy to operate, and feasible solution for almost any wooden doors, in any installation environment, with any designs, structure, and styles. Furthermore, because all the FERS devices are pre-installed inside the door leaf and doorframe, there is no special installation requirement, no change in normal door operation, no change in lock installation, no restriction on any lock brand and lock type, no moving parts to fail, no alternation in door appearance, no special door core materials required, no dirty rusty components, no addition space requirement, no change in entrance width, no violation of building fire codes, no need to deal with property management and owner association, and best of all, it costs only a fraction of a metal gate and can be used in any apartment buildings.

Another advantage of this FERS is that it concealed all its devices inside the door leaf and the doorframe. While the bolt-lock, addition external hardware, and metal gate options are visible to an intruder; which in turn gives the burglar a better chance of figuring out where is the weakest area to attack and to crack open the door or gate. On the contrary, since all the FERS devices are concealed and invisible, it would take the burglar more time and generate more noises before realizing it is a FERS security door; hence giving the dwellers inside or their neighbors more alarm signals to call the police sooner.

Some warehouses or outlets may use the Metal Sheet Door (MSD) as its security apparatus. MSD are wooden doors covered or wrapped by sheet metal on the outside, and hence, created a stronger barrier for burglary attempt. However, most metal sheet doors are flat doors with no design. That is why it is only used in warehouses or offices, but not used in households or apartments. The FERS uses an innovative approach, a total reverse of the MSD. All of its steel devices are installed inside of a wooden door. It is like a steel structure inside a wooden door!

There are several innovative features and new ideas used in this FERS which are first of its kind in the construction industry and in door engineering; presented a totally new product in the home safety market.

(A) It is an innovative approach to solve a hundred-year old security problem of wooden doors. Instead of using metal sheet or metal frame to armor the exterior of wooden doors, the FERS uses four concealed devices to strength the wood structure inside ordinary wooden doors to prevent fracturing even when burglary tools are used.

(B) The innovative design of four steel mounting devices and automatic latch bolt is first in the industry. All the four mounting devices are novel, original in design and in specification, and are first time in the door industry. The latch bolt itself is not a new idea, but the FERS modifies the design to make it more suitable for wooden doors and easy to install. The four devices are strategically concealed and installed in the weakest areas of wooden doors to strengthen the security function of locks and hinges.

(C) The innovative application of FERS makes it a totally flexible and feasible solution for any apartment environment, any installation conditions, and still complied with any fire code regulation. It is a one-for-all security solution, regardless of the door size and design. It works with any finish coating and any core materials, e.g. solid wood, veneer, MDF, etc. It can work with any types of lock and hinges. It can be used in any door structure, single leaf, double leaf, slide door, and even tempered glass door. Since everything is concealed, the property management or owners association won't even notice its existence and would not have any reasons to disapprove its use.

All in all, the FERS can satisfy consumers' desire in door appearance and security requirements, and yet at the same time it is a wooden door with forced entry resistance capability.

Two tests were conducted to examine the effectiveness of the FERS when induced with burglar attempts. The first test was done with pure physical force without any tools. The FERS devices were installed onto an ordinary wooden door leaf and doorframe. A pretended strong male burglar attempted to kick it open and rammed into. After 30 minutes of kicking and ramming, the lock and hinges were still in intact and the door was still in a closed and secured position. The door was still functioning perfectly normal and safely after the experimental burglary.

The second test was to simulate a burglar attempt with ordinary burglar tools, i.e., hammer, screwdriver and crowbar. The pretended burglar tried to crack open the wooden door by prying or jamming the door lock and door hinges. Again, after 15 minutes of a lot of noisy and violent actions, the wooden door installed with the FERS devices was still in its closed position, thereby stopping the burglar from force entering the apartment. Even the metal tools scratched the door's wood surface, but the wooden door armored with the FERS devices was able to continue to function as an effective security door and stopped the burglary force entry attempts.

While the forced entry resistance system for wooden doors has been shown and described with particular references to a number of preferred embodiments thereof, it should be noted that various other changes or modifications may be made without departing from the scope of the appended claims.

What is claimed is:

1. A forced entry resistance system for a wooden door set comprising a wooden lock-stile, a wooden hinge-stile, a wooden lock-jamb, and a wooden hinge-jamb, each being preinstalled with one or more fracture-resistant mounts completely concealed and invisible under door panels or embedded inside a doorframe on which a wooden door hangs, wherein the one or more fracture-resistant mounts comprise one or more door-stile fracture resistant mounts comprising:

(a) at least one rectangular plate mounted on one side of the hinge-stile;

(b) at least one L-shaped plate having first and second panels perpendicular to each other, the first panel being mounted on an opposite side of the hinge-stile and the second panel being mounted on an inner side of the hinge-stile facing the lock-stile; and (c) a connecting screw inserted through a hole on the rectangular plate, and through a first predrilled through-hole on the hinge-stile, and driven in a screw-hole on the first panel of the L-shaped plate.

2. The forced entry resistance system as claimed in claim 1, wherein the length of the L-shaped plate is 70-110 mm, the width of each panel of the L-shaped plate is 20-30 mm, the length of the rectangular plate is 300-400 mm, the width of the rectangular plate is 15-25 mm, and the thickness of the rectangular and the L-shaped plates is 1-5 mm.

3. The forced entry resistance system as claimed in claim 1, further comprising one or more doorframe fracture-resistant mounts pre-installed on and concealed by the doorframe from which the door is hung, the one or more doorframe fracture-resistant mounts being installed at positions where the one or more door-stile fracture-resistant mounts are located.

4. The forced entry resistance system as claimed in claim 3, wherein the doorframe fracture-resistant mount is in the form of a U-shaped mount comprising two spaced-apart vertical plates received in two corresponding spaced-apart vertical grooves formed on a side of the doorframe abutting against a wall on which the doorframe is mounted, and at least one central plate connecting to and extending between the two vertical plates.

5. The forced entry resistance system as claimed in claim 4, wherein the length of the two vertical plates is 300-400 mm, the width of the two vertical plates is 15-25 mm, the length of the central plate is 70-110 mm, and the thickness of the vertical and central plates is 1-5 mm.

6. The forced entry resistance system as claimed in claim 1, wherein the one or more fracture-resistant mounts comprise a door-lock fracture-resistant mount preinstalled on the lock-stile at a position where a door lock is provided.

7. The forced entry resistance system as claimed in claim 6, wherein the door-lock fracture-resistant mount comprises two vertical plates mounted on two opposite vertical sides of the lock-stile respectively, and a plurality of connecting members extending through a plurality of predrilled through-holes formed through the lock-stile respectively and connecting the two vertical plates together.

8. The forced entry resistance system as claimed in claim 7, wherein the length of the two vertical plates is 300-400 mm, the width of the two vertical plates is 15-25 mm, and the thickness of the two vertical plates is 1-5 mm.

9. A forced entry resistance system for a wooden door set comprising a wooden lock-stile, a wooden hinge-stile, a wooden lock-jamb, and a wooden hinge-jamb, each being preinstalled with one or more fracture-resistant mounts completely concealed and invisible under door panels or embedded inside a doorframe on which a wooden door hangs, wherein the one or more fracture-resistant mounts comprise one or more door-stile fracture resistant mounts comprising:

(a) one rectangular plate mounted on one side of the hinge-stile;

(b) two L-shaped plates each having first and second panels perpendicular to each other, the first panel being mounted on an opposite side of the hinge-stile and the second panel being mounted on an inner side of the hinge-stile facing the lock-stile; and (c) two connecting screws inserted through two holes on the rectangular plate, and through two first predrilled through-holes on the hinge-stile, and driven in two screw-holes on the first panel of each L-shaped plate respectively.

10. A method for manufacturing a door with a forced entry resistance system, the method comprising the steps of:

producing a wooden lock-stile, a wooden hinge-stile, a wooden lock-jamb, and a wooden hinge-jamb; and preinstalling each with one or more fracture-resistant mounts that are completely concealed and invisible under door panels or embedded inside a doorframe on which the door hangs, wherein the preinstalling steps comprise preinstalling one or more door-stile fracture resistant mounts on the hinge-stile at positions where door hinges are located, which comprises:

(a) mounting at least one rectangular plate on one side of the hinge-stile;

(b) providing at least one L-shaped plate having first and second panels perpendicular to each other, and mounting the first panel on an opposite side of the hinge-stile and the second panel on an inner side of the hinge-stile facing the lock-stile; and (c) inserting a connecting screw through a hole on the rectangular plate, and through a first predrilled through-hole on the hinge-stile, and driving the connecting screw in a screw-hole on the first panel of the L-shaped plate.

11. The method for manufacturing a door with a forced entry resistance system as claimed in claim 10, wherein the length of the L-shaped plate is 70-110 mm, the width of each panel of the L-shaped plate is 20-30 mm, the length of the rectangular plate is 300-400 mm, the width of the rectangular plate is 15-25 mm, and the thickness of the rectangular and the L-shaped plates is 1-5 mm.

12. The method for manufacturing a door with a forced entry resistance system as claimed in claim 10, wherein the preinstalling steps comprise preinstalling and concealing one or more doorframe fracture-resistant mounts on the doorframe on which the door hangs, the one or more doorframe fracture-resistant mounts being installed at positions where the one or more door-stile fracture-resistant mounts are located.

13. The method for manufacturing a door with a forced entry resistance system as claimed in claim 12, wherein the step of preinstalling the one or more doorframe fracture-resistant mounts on the doorframe comprises providing a U-shaped mount comprising two spaced-apart vertical plates and at least one central plate connecting to and extending between the two vertical plates; and inserting the two vertical plates in two corresponding spaced-apart vertical grooves formed on a side of the doorframe abutting against a wall on which the doorframe mounts.

14. The method for manufacturing a door with a forced entry resistance system as claimed in claim 13, wherein the length of the two vertical plates is 300-400 mm, the width of the two vertical plates is 15-25 mm, the length of the central plate is 70-110 mm, and the thickness of the vertical and central plates is 1-5 mm.

15. The method for manufacturing a door with a forced entry resistance system as claimed in claim 10, wherein the preinstalling steps comprise preinstalling a door-lock fracture-resistant mount on the lock-stile at a position where a door lock is provided.

16. The method for manufacturing a door with a forced entry resistance system as claimed in claim 15, wherein the step of preinstalling the door-lock fracture-resistant mount on the lock-stile comprises mounting two vertical plates on two opposite vertical sides of the lock-stile respectively, and inserting a plurality of connecting members through a plurality of predrilled through-holes formed through the lock-stile respectively and connecting the two vertical plates together.

17. The method for manufacturing a door with a forced entry resistance system as claimed in claim 16, wherein the length of the two vertical plates is 300-400 mm, the width of the two vertical plates is 15-25 mm, and the thickness of the two vertical plates is 1-5 mm.

* * * * *